United States Patent [19]

Stull

[11] 4,424,918

[45] Jan. 10, 1984

[54] NON-RESEALABLE DISPENSER CAP CONSTRUCTION

[76] Inventor: Gene Stull, 5 Oak St., Chester, N.J. 07930

[21] Appl. No.: 312,147

[22] Filed: Oct. 16, 1981

[51] Int. Cl.[3] ..... B67B 5/00

[52] U.S. Cl. ..... 222/153; 215/313; 222/499; 222/521; 604/110

[58] Field of Search ..... 215/311, 313; 251/351; 239/539; 222/147, 153, 519–521, 402.14, 499; 604/110

[56] References Cited

U.S. PATENT DOCUMENTS

| | | | |
|---|---|---|---|
| 2,368,836 | 2/1945 | Holwick | 222/147 X |
| 3,259,282 | 7/1966 | Jellesen | 222/521 |
| 3,263,851 | 8/1966 | Grimsley | 222/521 |
| 3,370,764 | 2/1968 | Stull | 222/499 |
| 3,420,413 | 1/1969 | Corsette | 222/147 |

*Primary Examiner*—David A. Scherbel

[57] ABSTRACT

A non-resealable dispenser cap construction for a container, comprising a cap body part having a discharge opening, an orifice part movable between sealing and unsealing positions and adapted to selectively seal off the discharge opening, and means for preventing reclosing of the cap construction following an initial dispensing operation. There are provided cooperable camming surfaces on the cap body and orifice parts, which tend to hold the latter part in a sealing position, as during shipping. A one-way drive thread is provided, functioning when the orifice part is turned in an unscrewing direction, but being inoperable when the orifice part is thereafter turned in a screwing-on direction. Interference shoulders prevent the orifice part from returning to its sealing position, following an initial discharge. Once the orifice part is moved from its fully on or sealing position, it cannot normally be returned, thus there is prevented re-sealing of the container and possible subsequent risk or danger of pressure build-up therein.

22 Claims, 8 Drawing Figures

NON-RESEALABLE DISPENSER CAP CONSTRUCTION

BACKGROUND

This invention relates generally to non-resealable dispensers, and more particularly to dispensers of this type which employ a screw cap that is receivable on a cap body, which latter in turn is intended to be secured to a dispensing container.

A number of prior non-resealable dispensers have been proposed and produced, going back a considerable number of years. Known non-resealable containers of one form or another are illustrated in U.S. Pat. Nos. 797,698; 922,335; 1,040,500; and 3,227,303.

U.S. Pat. No. 922,335 relates to a dispenser for wine or other liquids, wherein an overcap is permanently retained on the neck of a bottle by means of multiple spring clips. The overcap has a hollow interior, with a cork that is initially pressed into the discharge opening of the neck. Connected to the cork is a string which in turn carries a pull-ring, such that when the user desires to un-cork the dispenser, he merely pulls on the ring and dislodges the cork. Due to the fact that the cork is confined within the hollow interior of the overcap, re-installation of the cork in the bottle neck is prevented.

U.S. Pat. No. 797,698 shows a non-refillable bottle employing a cork or stopper that is carried by an actuator rod. In this particular construction, the cork is disposed in a tapered bore, such that once it becomes dislodged from its sealing position, it cannot be easily returned thereto. FIG. 1 of this patent shows the container in the sealing position, whereas FIG. 2 illustrates the container in the dispensing condition.

U.S. Pat. No. 1,040,500 discloses a non-refillable bottle employing a stopper plug having multiple longitudinal transverse slots which carry a number of spring clips. The clips are intended to be received in interior longitudinal and transverse slots or recesses in the bottle neck, and function to prevent return of the stopper to its sealing position once the container has been opened.

Yet another construction is illustrated in U.S. Pat. No. 3,227,303. In this patented arrangement, a bottle or similar container having an enlarged neck portion is provided with a resilient ferrule which, in a temporary manner, holds captive a bulbous stopper member. The ferrule, being somewhat resilient, can yield an extent; when it is desired to use the dispenser, the stopper member is merely tilted to become clear of the flange of the ferrule. The arrangement is such that re-installation of the stopper member is difficult or impossible to achieve. Several different constructions are illustrated, showing different manners of retention of the stopper member by the ferrule.

All of the above patents involve containers or dispensers that are provided to the consumer in a closed or sealed condition, and where it is intended that the consumer merely open the container, as by a relatively simple operation, after which it is not possible for the container to be re-closed, or sealed up.

In one new product that is currently being developed, namely a hair-coloring kit, it is necessary for the consumer to mix together several substances that are supplied separately in the kit, and thereafter apply the resultant mixture to the hair in the usual manner. With products of this type, it is necessary for the container to be able to accomodate the initial mixing operation, preferably with a minimum of mess or inconvenience, so that spillage or waste of the product does not occur. Moreover, it has been found that in many cases, after such substances are mixed the resultant reaction between them releases small quantities of gas. If the individual parts of the kit were to be mixed in a conventional glass or plastic bottle with the usual screw cap closure, it is possible that there could result an undesirable pressure build-up within the container, causing it either to explode or else rupture, giving rise to problems of leakage, etc.

To my knowledge, there do not exist any simple dispensers which maintain the capability for removal of a closure piece so as to facilitate using the dispenser to mix one or more substances together, while at the same time providing a non-resealable turn-type structure on the closure piece, whereby once the latter is replaced on the container and an initial dispensing operation is performed, resealing of the container becomes difficult or impossible.

SUMMARY

The above disadvantages and drawbacks of prior non-resealable dispenser cap constructions are largely obviated by the present invention, which has for an object the provision of a novel and improved non-resealable dispenser which is both extremely simple in its structure, and easy to use from the standpoint of the consumer.

A related object of the invention is to provide an improved non-resealable cap construction as above set forth, wherein multiple sealing points are incorporated in the various parts, so as to largely reduce or eliminate the possibility of undesirable leakage occurring, as during shipping or storage.

Still another object of the invention is to provide an improved, especially simple two-piece non-resealable construction as above characterized, wherein the individual parts can be economically molded in simple mold cavities.

Yet another object of the invention is to provide an improved cap construction as above set forth, wherein provision is made for removing one cap part from the container, so as to enable mixing of one or more liquids therein, and thereafter permitting replacement of the cap immediately following such mixing, to enable the dispenser to be used in the conventional manner.

The above objects are accomplished by a novel non-resealable cap construction for a container, comprising a cap body part having a discharge opening, an orifice part movable between sealing and unsealing positions and adapted to selectively seal off the discharge opening, and means for preventing reclosing of the cap construction following an initial dispensing operation. Cooperable camming surfaces on the cap body part and orifice part normally hold the latter in a position wherein the discharge opening is sealed off, as during storage or shipping. In addition a one-way-drive thread arrangement on the cap body part and orifice part operates to raise the latter when it is turned in an unscrewing direction, but is rendered inoperative for reverse action thereafter, in spite of turning of the orifice part in a screwing-on direction. Interference shoulders on the cap body part and orifice part prevent the orifice part from being returned to its sealing position. Thus, once the orifice part is removed from its full-on or sealing position, it cannot normally be returned to such position. As a result, there is prevented resealing of the container. Such a non-resealable feature is important from the standpoint of preventing pressure build up within the container, as might occur with certain substances that were intended to be dispensed, especially over a period of time.

By virtue of the fact that the cap body part can be unscrewed from the container, there is greatly facilitated the use of the container for mixing together two substances, as would be required in the case of certain newly-developed hair coloring formulations. Thereafter, following reinstallation of the cap body part on the container, and after an initial dispensing operation has occurred, the container is rendered non-resealable, so as to eliminate any hazard associated with the build up of gas that may have resulted from the mixing of the substances together. Accordingly, problems with leakage, or possible bursting of the container are virtually completely eliminated.

Other features and advantages will hereinafter appear.

In the drawings, illustrating several embodiments of the invention:

Figure 1:
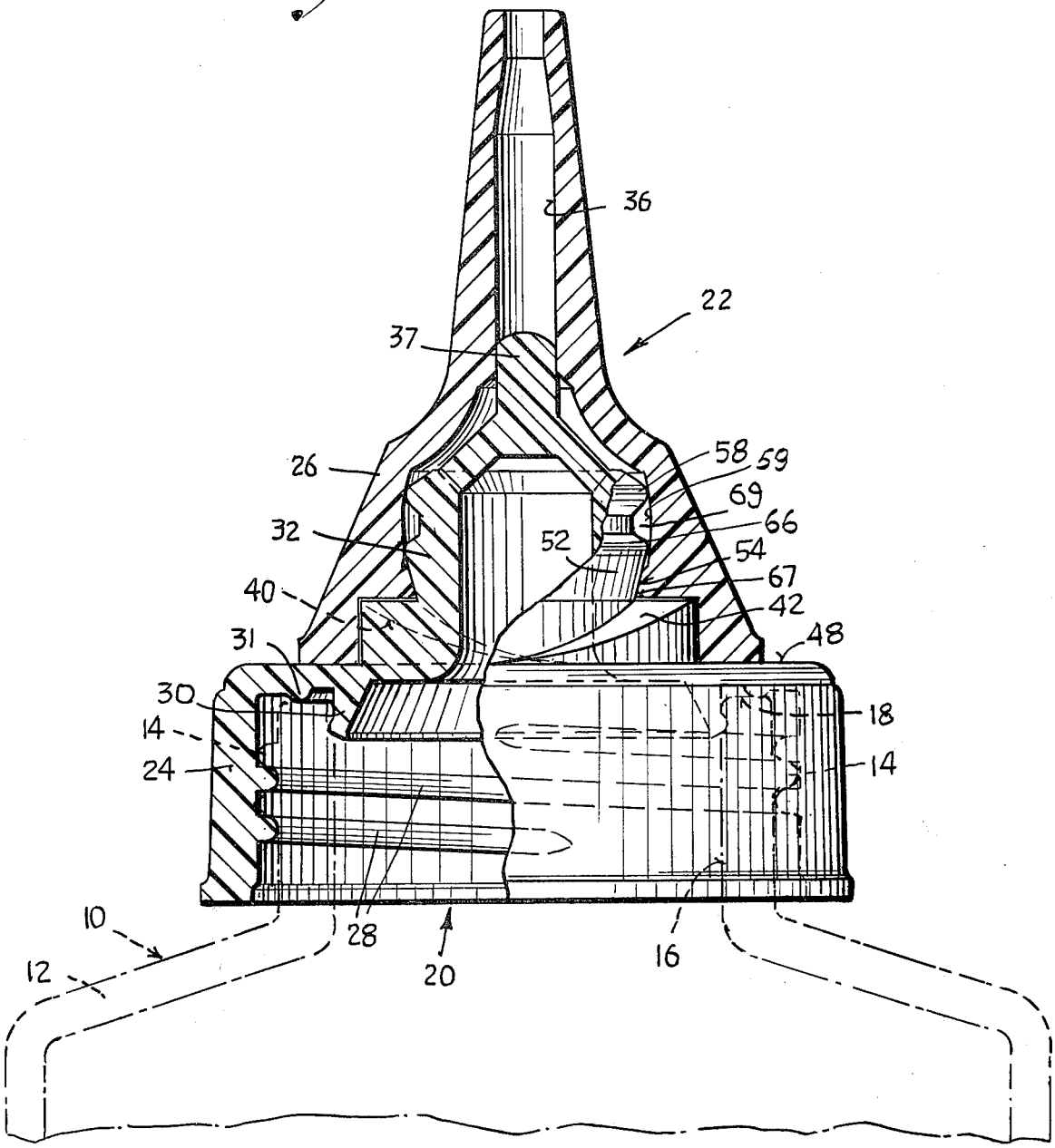
FIG. 1 is an enlarged view, partly in front elevation and partly in axial section, of the improved non-resealable cap construction of the present invention, showing it assembled to a bottle or container having a threaded neck, and illustrating the orifice part in the full-on or sealing position.

Referring first to FIG. 1 there is illustrated a dispenser for liquids generally designated by the numeral 10, including a dispensing container 12 which may be in the form of a plastic or glass bottle having external threads 14 on its neck 16, and having a lip 18 surrounding a dispensing orifice 20.

A dispensing cap construction 22 is provided, comprising a cap body part 24 and an orifice part 26. The body part 24 has internal screw threads 28 which are cooperable with the threads 14 of the neck 16. On the underside of the cap body part 24 is a depending annular flange 30 which is resilient, and which is intended to deform radially inwardly an extent as shown, during its engagement with the inner surface of the container neck 16. Such an arrangement provides a seal between the body part 24 and container 12, to prevent leakage of the contents thereof. An additional seal is provided by a small annular bead 31, which is engageable with the lip 18 as shown.

Figure 2:
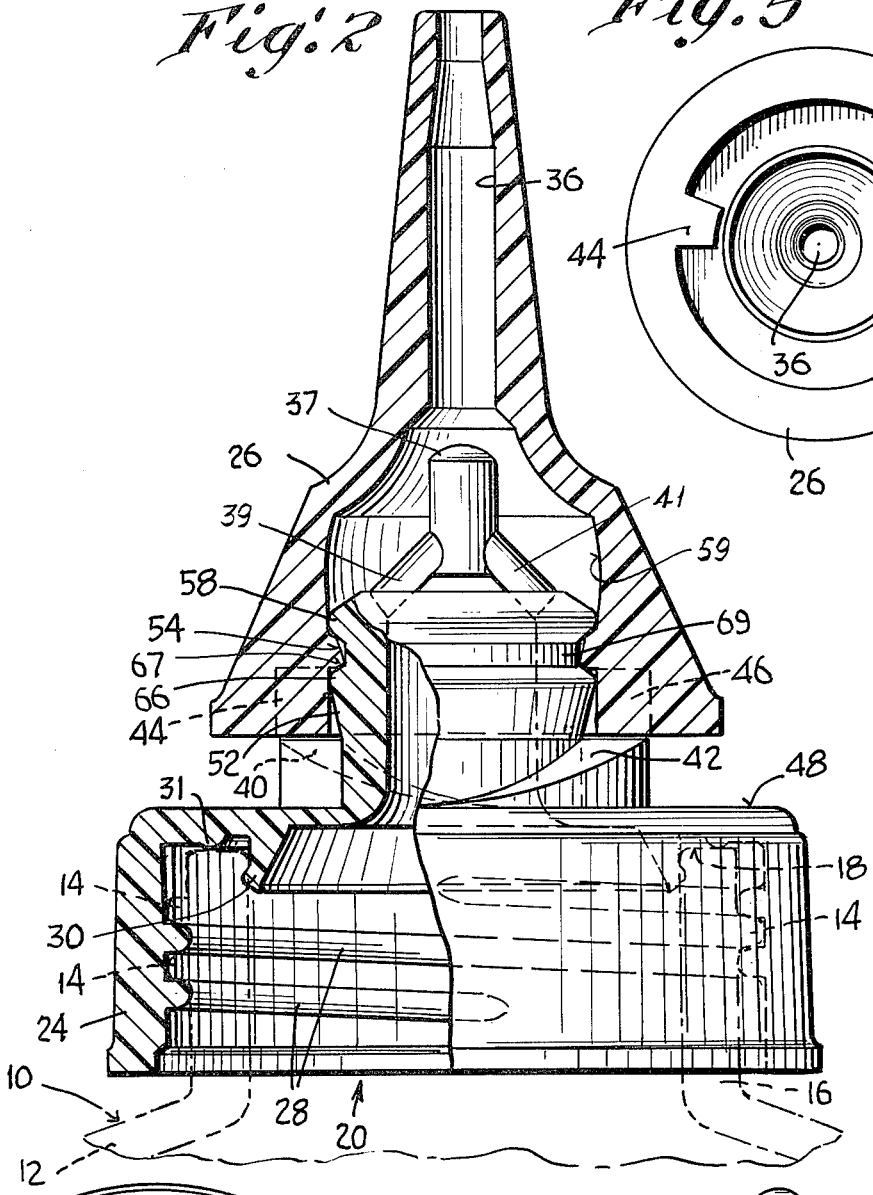
FIG. 2 is a view like FIG. 1, except showing the orifice part as having been turned in a counterclockwise direction so as to raise it to its discharge position.
Figure 3:
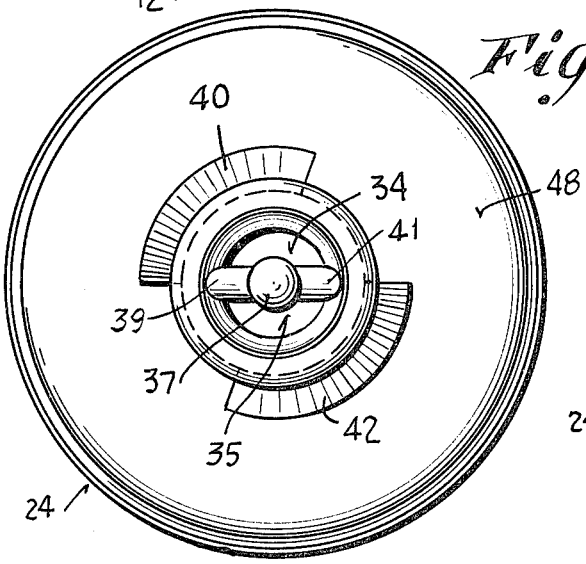
FIG. 3 is a top plan view of the cap body part of the construction of FIGS. 1 and 2.
Figure 4:
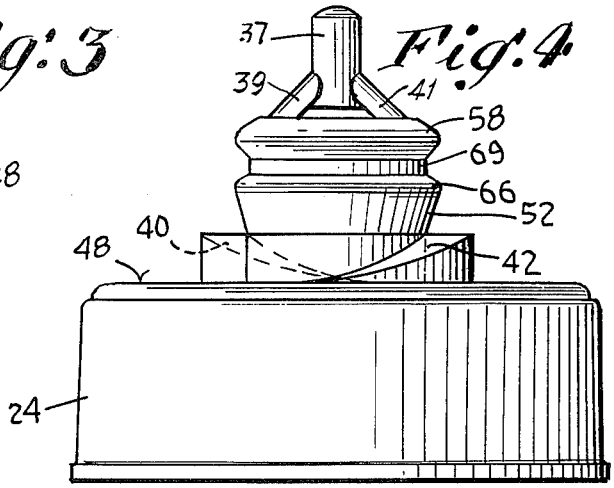
FIG. 4 is a front elevational view of the cap body part of FIG. 3.

The body part 24 has an integral upstanding spout portion 32 with multiple dispensing apertures 34, 35, FIG. 3. The orifice part 26 has a hollow bore 36 through which the product can flow when the part is disposed in an open or un-sealing condition, as shown in FIG. 2. The mouth of the bore 36 is intended to be closed off by a protruding sealing plug or peg 37 when the orifice part is disposed in the sealing position of FIG. 1. The plug is supported by means of oppositely disposed legs 39, 41.

In accordance with the present invention, the orifice part 26 is movable between a fully-on or sealing position shown in FIG. 1, and an open or discharge position shown in FIG. 2. Means are provided for preventing the orifice part 26 from being returned to the fully-on or sealing position once the cap has been opened. In accomplishing the non-resealable function, there is provided on the body part 24 a one-way-thread drive in the form of a double cam track, one track being indicated by the numeral 40 and the second by the numeral 42. As shown, the tracks 40, 42 extend through angles slightly in excess of 90°, although this is not necessary in order for proper functioning of the dispenser. That is, greater or lesser arcuate lengths of the cam tracks 40, 42 would likely provide satisfactory results.

Figure 5:
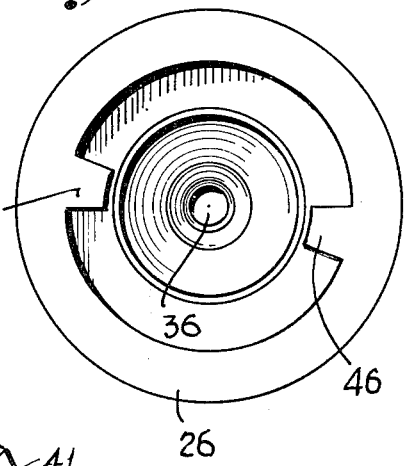
FIG. 5 is a bottom plan view of the orifice part, particularly illustrating oppositely disposed lugs that are intended to cooperate with the cam track on the cap body part.

Referring to FIG. 5, there are cooperable with the cam tracks 40, 42 a pair of lugs 44, 46 on the underside of the orifice part 26, which are intended to ride up the tracks 40, 42 when the part is turned in an unscrewing direction. In the position shown in FIG. 1, the lugs 44, 46 are in engagement with the upper surface 48 of the cap body part 24. That is, neither of the lugs 44, 46 has begun to ride up the respective track 40, 42.

Referring again to FIG. 1, there are provided on the orifice part 26 and cap body part 24 cooperable yieldable camming surfaces indicated by the numerals 52 and 54. Due to the resilience of the substances of which the cap body part 24 and orifice part 26 are constituted, the wall adjacent to the surface 54 can yield a limited extent in a radially outward direction so as to be capable of by-passing the surface 52. Some yielding of the wall defining the surface 52 also occurs. In the fully-on or sealing position shown in FIG. 1, the surfaces 52, 54 seal against one another so as to eliminate leakage, as during storage or shipping. In addition, it is noted that the surfaces 52, 54 are both of generally conical configuration, such that as the orifice part 26 moves axially outward, minimal friction between them occurs, thus eliminating the likelihood of undesirable interference at this location.

Referring again to FIG. 1, it can be seen that a shoulder 58 in the form of an interference bead is provided on the exterior surface of the spout 32. This bead functions to retain the orifice part 26 in the position shown in FIG. 2, by preventing complete removal thereof. In other words, there exists sufficient interference between the surface 54 and the shoulder 58 so as to prevent the orifice part 26 from being completely removed from the spout 32 and the remainder of the cap body part 24. Also, the shoulder 58 seals against the inner surface 59 of the orifice part 26.

In accordance with the present invention, there is provided another shoulder 66 of relatively sharp configuration, the shoulder 66 being adapted for engagement with a cooperable shoulder 67 just below the surface 54, so as to prevent the orifice part 26 from being moved axially inward from the position of FIG. 2 to the position of FIG. 1. Such an arrangement prevents the orifice part 26 from being re-sealed, and thereby eliminates the possibility of pressure build-up occurring in the container 12. That is, any vapors which would tend to accumulate in the interior of the container are harmlessly vented through the apertures 34, 35, past the sealing peg 37 and out through the passage or bore 36.

The shoulders 58 and 66 define an undercut or annular groove 69 between them, which is seen to receive or accommodate that portion of the orifice part 26 adjacent the surface 54 when the parts are disposed in the relative positions shown in FIG. 2.

The operation of the improved dispenser cap construction can now be readily understood. At the factory or manufacturing facility where the dispenser caps are assembled, the orifice part 26 can be forcibly assembled by automatic capping equipment to the cap body part 24. During such assembly, the shoulder 67 and surface 54 are forced past the shoulders 58 and 66, to the fully-on or sealing position illustrated in FIG. 1. In order to do this, it is necessary that the lugs 44 and 46 on the orifice part 26 be turnably oriented so that they will not be in a position wherein they interfere with the cam track 40 or cam track 42. In the fully-on or sealing position, the plug 37 provides a seal of the dispenser. The orifice part 26 is retained in the fully-on position by the engagement of the camming surfaces 54 and 52. With the shoulder 58 sealing against the inner surface 59 of the orifice part 26, there is prevented leakage into the area around the groove 69.

The present dispenser is intended to be used with products such as hair coloring kits that require the consumer to mix one or more substances together. After the consumer purchases the dispenser 10, the required ingredients can be mixed therein by unscrewing of the cap body part 24 from the container neck 16, to permit access to its interior. Thereafter the body part 24 is replaced. When it is desired to dispense the mixture, the consumer grips the orifice part 26 and imparts an unscrewing movement thereto. After a partial rotation has occurred, the lugs 44, 46 will begin to ride up the cam tracks 40, 42, forcing the surface 54 to slide past the surface 52 and causing the shoulder 67 to arrive at and snap into the undercut or groove 69. Due to the presence of the shoulder 58, further outward movement of the orifice part 26 is prevented. Also, since the lugs 44, 46 and cam tracks 40, 42 are capable of moving the orifice part 26 in an axially outward direction only, turning of the orifice part 26 in a clockwise direction from the open position shown in FIG. 2, will not result in downward axial movement. Moreover the interference between the shoulder 66 and the shoulder 67 is sufficiently strong so as to resist any attempt by the consumer to force these shoulders past one another, and thus re-seal the dispenser. Accordingly, such re-sealing is effectively prevented.

Figure 6:
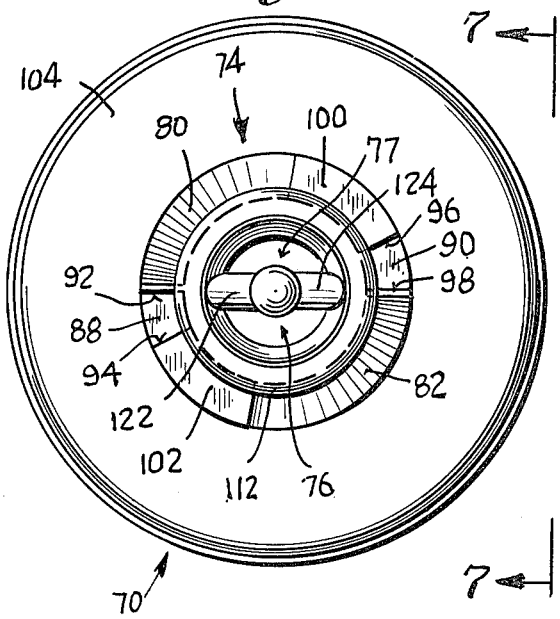
FIG. 6 is a top plan view similar to FIG. 3, of a modified construction, constituting another embodiment of the invention.
Figure 7:
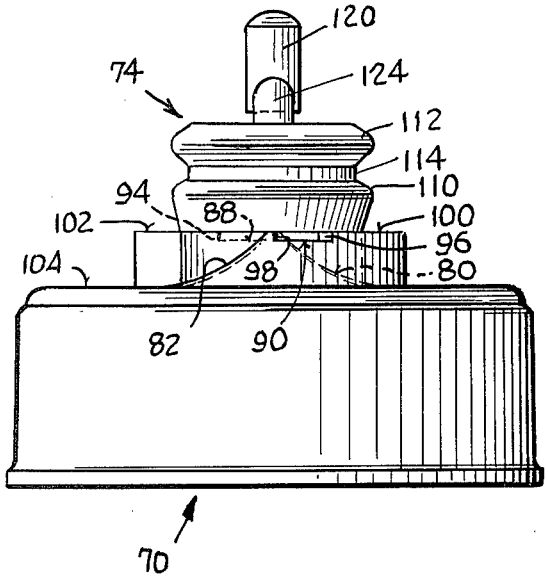
FIG. 7 is a view like FIG. 4, of the modified construction of FIG. 6.
Figure 8:
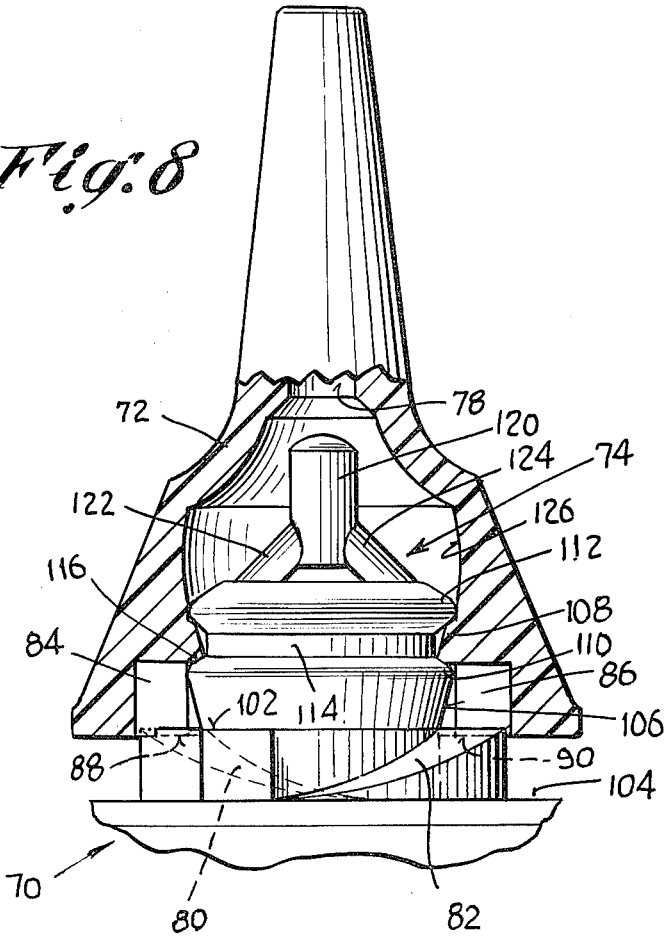
FIG. 8 is a view like FIG. 2, of the modification of FIGS. 6 and 7.

Another embodiment of the invention is illustrated in FIGS. 6–8, which relate to a slightly modified construction of a non-resealable dispenser. FIGS. 6 and 7 show a molded plastic cap body part generally designated by the numeral 70, together with an orifice part 72 that is adapted to be received thereon. The part 70 has an integral upstanding spout 74 with multiple dispensing apertures 76, 77 for permitting discharge of the contents of the dispenser as in the previous embodiment. The orifice part has a hollow bore 78 through which the product being dispensed can flow.

By the present invention, cooperable structures are provided on the cap body part 70 and orifice part 72 for preventing the latter from being returned to a fully-on or sealing position once an initial discharge has occurred. In accomplishing this function, there is disposed on the body part 70 a one-way-thread drive, comprising a double cam track 80,82, shown as extending through angles just in excess of 90°. Cooperable with the tracks 80, 82 is a pair of lugs 84, 86 diametrically opposed and located on the underside of the orifice part 72. The lugs 84, 86 can be similar to those indicated by the numerals 44, 46 in FIG. 5, these being intended to ride up the tracks 80, 82 when the orifice part 72 is turned in an unscrewing direction.

Further in accordance with the invention, there is disposed at the top of the tracks 80, 82 a pair of notches 88, 90 which are of an arcuate dimension slightly in excess of the arcuate dimensions of the lugs 84, 86. That is, as the orifice part 72 is unscrewed from the fully-on position, corresponding to that shown in FIG. 1 of the first embodiment, the lugs 84, 86 will arrive at the locations of the notches 88, 90, respectively, and will become seated therein. As shown in FIG. 6, the notch 88 has abutment surfaces 92, 94, with the notch 90 having abutment surfaces 96, 98. It can be readily understood that once the respective lug 84, 86 becomes seated in the corresponding notch 88, 90, the abutment surfaces 92, 94 and 96, 98 will prevent further rotation of the orifice part 72 in either a clockwise or counterclockwise direction. In FIG. 6, the portions 100, 102 represent generally flat, raised surfaces, lying in planes generally parallel to but spaced from the surface 104 (FIG. 8) of the cap body part 70.

Referring again to FIGS. 7 and 8, there is disposed on the cap body part 70 and orifice part 72, cooperable camming surfaces 106, 108, respectively which are normally in engagement with one another when the orifice part 72 is in the fully-on position. Such engagement tends to retain the orifice part in this position during storage or shipping. Due to the resilience of the orifice part 72, the camming surface 108 can yield a limited extent in a radially outward direction so as to facilitate by-passing of the surfaces 106, 108, as the lugs 84, 86 ride up the respective cam track 80, 82, during opening of the dispenser.

FIGS. 7 and 8 show a pair of shoulders 110, 112, defining a groove 114 therebetween. The shoulder 12 is adapted to engage the camming surface 108 in the position illustrated in FIG. 8, thereby preventing complete removal of the orifice part 72 from the cap body part 70. In addition, it can be seen that a small annular shoulder 116 is provided, which is intended to engage the shoulder 110 in the position of FIG. 8.

The dimensions of the parts 70, 72 are such that once the lugs 84, 86 begin to arrive at the locations of the notches 88, 90, respectively, the surface 108 has been caused to ride up and onto the shoulder 112 by a slight extent, causing a momentary radially outward camming action of the walls of the part 72 in the vicinity of this surface 108. Thereafter, when the lugs 84, 86 finally do arrive at the notches 88, 90 respectively, the resilience of the camming surface 108 and shoulder 112 causes the orifice part 72 to move slightly in a radially downward direction, wherein the bottom surfaces of the lugs 84, 86 become fully seated in the respective notches 88, 90. That is, the orifice part 72 tends to snap into this fully seated position. From this position, attempts by the consumer to rotate the orifice part 72 in either a clockwise or counterclockwise direction will be resisted, by virtue of the engagement of the lugs 84, 86, and the abutments 92, 94 and 96, 98.

As in the previous embodiment, the spout portion 74 has an upstanding sealing plug 120 which is received in the mouth of the bore 78 of the orifice part 72 when the latter is in the fully-on or sealing position. The plug 120 is supported by means of oppositely disposed lugs 122, 124.

With the orifice part 72 of FIG. 8 disposed in the fully-on or sealing position corresponding to that shown in FIG. 1 of the first embodiment, the inner surface 126 of the orifice part 72 sealingly engages the shoulder 112 of the spout 74, so as to prevent product from leaking past the shoulder 112 and solidifying in the area adjacent the groove 114. Accordingly, this area around the groove 114 is maintained free and clear of product, thus eliminating any problems which might occur with solidifying product becoming encrusted in or around the groove 114, and possibly interfering with proper operation of the dispenser.

From the above it can be seen that I have provided a novel and improved, non-resealable dispenser which can be economically manufactured, and readily molded as two separate parts. The particular construction that is disclosed has the advantage that the cap body part can be completely removed from the container, to permit mixing of one or more substances therein, and thereafter replaced by the consumer. The cap body part is intended to be tightened fully on the container neck. Then, following unscrewing of the orifice part 26 or 72, and after an initial discharge of the resultant mixture, the cap construction cannot normally be resealed, that is, once the orifice part 26 or 72 is unscrewed, the container will remain vented at all times. Thus, even if there occurs a tendency for gas to form following mixing of the individual substances, the positive venting provided will prevent pressures from being built up within the container, thus eliminating problems with possible bursting, or splitting of the container along a seam or other weak spot. In addition, it is particularly important that there be minimized possible hazards associated with accidental squirting of liquid from pressurized dispensers. This is particularly important in the hair coloring field, since many of the substances that have been used in the past have been known to be damaging, or at best moderately irritating to the eyes.

The present construction is seen to eliminate many of the hazards of this nature, and is thus seen to have important safety features.

While the arrangements that have been disclosed all involve a body part 24 or 70 that is adapted to be releasably secured to the container 12, as by suitable screw threads, it is possible to apply the principles of the present invention to a construction where the body part was permanently secured to the container, as by a locking thread arrangement, or a snap-in type permanent retention. Under such circumstances, the consumer could effect the mixing of the necessary products by introduction of a suitable funnel or adapter tip of some sort into the orifice 36 or 78, with the orifice part 26 or 72 in the open or unsealed position. Following the introduction of the second substance into the container through the orifice, the contents could then be swirled gently in order to effect the mixing, and the dispensing operation commenced.

The arrangements that have been described above are thus considered to represent a distinct advance and improvement in the technology of dispensing containers.

Each and every one of the appended claims defines an aspect of the invention that is separate and distinct from all others, and accordingly each claim is to be treated in this manner when examined in light of the prior art, in any determination of novelty or validity.

Variations and modifications are possible without departing from the spirit of the invention.

What is claimed is:

1. A non-resealable dispenser cap construction for a container, comprising in combination:

(a) a cap body part having a discharge opening, (b) an orifice part having sealing means, movable on the cap body part between sealing and unsealing positions, (c) cooperable yieldable retainer means on the cap body part and orifice part, tending to hold the latter in its sealing position, (d) means on said parts, providing a one-way-drive thread operable when the orifice part is turned to shift it and clear the discharge opening, said thread being inoperable to return the orifice part to re-seal the dischrge opening, and (e) interference means on the cap body part and orifice part for normally preventing the latter from shifting to its sealing position once it has been moved therefrom, thereby normally preventing the container from being re-sealed.

2. The invention as defined in claim 1, wherein:

(a) said one-way-drive thread means comprises a cam track on one of said parts, and (b) a lug on the other of said parts, engageable with the cam track when the orifice part is turned in an unscrewing direction, said lug being adapted to ride along the cam track so as to cause axial movement of the orifice part.

3. The invention as defined in claim 2, wherein:

(a) said cam track has means cooperable with the said lug, for receiving the latter and holding the orifice part against further turning movement in an unscrewing direction when the orifice part has reached a certain point along the cam track.

4. The invention as defined in claim 3, wherein:

(a) said lug-receiving means comprises means defining a notch in said cam track, (b) said lug being receivable in said notch.

5. The invention as defined in claim 4, and further including:

(a) a shoulder on the cap body part, (b) said orifice part having an internal camming surface engageable with the shoulder of the cap body part when the orifice part is turned in an unscrewing direction, (c) said engagement of the camming surface and shoulder occurring before the lug arrives at the said notch, (d) said engagement of the camming surface and shoulder providing a spring bias to the orifice part in a downward axial direction, so as to retain the lug in a seated position in the notch, and to prevent further rotation of the orifice part with respect to the cap body part from the said position.

6. The invention as defined in claim 1, wherein:

(a) said one-way-drive thread means comprises a pair of cam tracks on one of said parts, and (b) a pair of lugs generally diametrically opposed on the other of said parts and engageable with the cam tracks respectively when the orifice part is turned in an unscrewing direction, said lugs being adapted to ride along the cam tracks so as to cause axial movement of the orifice part.

7. The invention as defined in claim 6, wherein:

(a) both of said cam tracks have means cooperable with the lugs, for receiving the latter and holding the orifice part against further turning movement in an unscrewing direction when the lugs have reached certain points along the respective cam tracks.

8. The invention as defined in claim 7, wherein:

(a) said lug-receiving means comprises means defining a pair of notches, one in each cam track, (b) said lugs being receivable in said notches, respectively.

9. The invention as defined in claim 8, wherein:

(a) said notches are substantially diametrically opposed to one another.

10. The invention as defined in claim 8, and further including:

(a) a shoulder on the cap body part, (b) said orifice part having an internal camming surface engageable with the shoulder of the cap body part when the orifice part is turned in an unscrewing direction, (c) said engagement of the camming surface and shoulder occurring before the lugs arrive at the said notches, (d) said engagement of the camming surface and shoulder providing a spring bias to the orifice part in a downward axial direction, so as to retain the lugs in seated positions in the notches, and prevent further rotation of the orifice part with respect to the cap body part.

11. The invention as defined in claim 1, wherein:

(a) said yieldable retainer means comprises a camming surface on one of said parts, and (b) a cooperable camming surface on the other of said parts, engageable with the camming surface of the first part, (c) the engagement of said camming surfaces tending to hold the orifice part in its sealing position.

12. The invention as defined in claim 11, wherein:

(a) said camming surface on the orifice part comprises a bead-like formation of annular configuration.

13. The invention as defined in claim 11, wherein:

(a) the camming surfaces of the cap body part and orifice part are resilient, so as to enable the camming surface of the orifice part to yield in a radially outward direction and to by-pass the camming surface of the cap body part when the orifice part is forcibly turned in an unscrewing direction.

14. The invention as defined in claim 12 wherein:

(a) said camming surface on the orifice part is of substantially conical configuration.

15. The invention as defined in claim 1, wherein:

(a) the interference means comprises a shoulder on the cap body part, and (b) means providing a cooperable shoulder on the orifice part, engageable with the shoulder of the cap body part after the orifice part has been turned in an unscrewing direction to a predetermined extent, (c) the engagement of said shoulders normally preventing downward axial movement of the orifice part once the latter has been turned in an unscrewing direction to said predetermined extent.

16. The invention as defined in claim 15, and further including:

(a) an additional shoulder on the cap body part, disposed above and spaced from the first shoulder, (b) said yieldable retainer means comprising a camming surface on the orifice part, (c) said additional shoulder being engageable with the camming surface on the orifice part to retain the latter against removal from the body part.

17. The invention as defined in claim 16, wherein:

(a) the shoulders on the cap body part define a groove into which the camming surface of the orifice part can seat, so as to prevent axial movement of the orifice part in either an upward or downward axial direction.

18. The invention as defined in claim 17, wherein:

(a) the additional shoulder on the cap body part is sealingly engageable with the inner surface of the orifice part, so as to provide a seal therewith and prevent leakage of the contents of the container into the said groove.

19. The invention as defined in claim 1, wherein:

(a) the cap body part has an upstanding spout portion containing said discharge opening, (b) said spout portion having a protruding sealing plug, (c) said orifice part having a dispensing aperture with a mouth adjacent to said plug, (d) said plug being sealingly received in the mouth of the aperture when the orifice part is in its sealing position, so as to close off the aperture and prevent leakage of the contents of the container.

20. The invention as defined in claim 1, wherein:

(a) said cap body part has an internally threaded portion, adapted to be screwed onto the threaded neck of a container, (b) said cap body part being capable of being completely removed from said container for the purpose of enabling additional substances to be introduced into the container by the consumer and thereafter mixed together.

21. The invention as defined in claim 1, wherein:

(a) said cap body part has an internally threaded portion, adapted to be screwed on the threaded neck of a container, (b) said threaded portion having an annular resilient and deformable, depending sealing skirt adapted to engage the neck of the container, for sealing engagement with the inner wall thereof.

22. The invention as defined in claim 21, wherein:

(a) the cap body part has a resilient, deformable annular sealing bead adjacent the location of the threaded portion, for engagement with the neck of the container to prevent leakage of the container contents into the area around the threaded neck.

* * * * *